US012372094B2

(12) United States Patent
Tokuno

(10) Patent No.: US 12,372,094 B2
(45) Date of Patent: Jul. 29, 2025

(54) BLOWER AND METHOD OF MANUFACTURING THE SAME

(71) Applicant: Nidec Corporation, Kyoto (JP)

(72) Inventor: Yuta Tokuno, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 18/381,207

(22) Filed: Oct. 18, 2023

(65) Prior Publication Data

US 2024/0133387 A1 Apr. 25, 2024
US 2024/0229806 A9 Jul. 11, 2024

(30) Foreign Application Priority Data

Oct. 21, 2022 (JP) ..... 2022-168921

(51) Int. Cl.
*F04D 19/00* (2006.01)
*F04D 29/32* (2006.01)
*F04D 29/52* (2006.01)

(52) U.S. Cl.
CPC ..... *F04D 19/007* (2013.01); *F04D 19/002* (2013.01); *F04D 29/325* (2013.01); *F04D 29/522* (2013.01)

(58) Field of Classification Search
CPC ..... F04D 19/007; F04D 19/00; F04D 19/002; F04D 29/325; F04D 29/32; F04D 29/522; F04D 29/52; F04D 29/64; F04D 29/646; F04D 25/166; F04D 25/16; F04D 25/0693
See application file for complete search history.

(56) References Cited

U.S. PATENT DOCUMENTS 4,098,547 A * 7/1978 Wrobel ..... H01R 24/66 439/527
6,431,910 B1 * 8/2002 Chuang ..... H05K 7/20172 439/577
6,827,549 B1 * 12/2004 Horng ..... F04D 19/007 415/214.1
7,156,611 B2 * 1/2007 Oosawa ..... F04D 19/007 415/199.5
7,273,400 B2 * 9/2007 Horng ..... F04D 19/007 439/502
8,109,743 B2 * 2/2012 Yoshida ..... F04D 25/0693 417/244
8,821,129 B2 * 9/2014 Heli ..... F04D 29/701 416/247 R
10,935,033 B2 * 3/2021 Lin ..... F04D 25/0613
(Continued)

*Primary Examiner* — Woody A Lee, Jr.
*Assistant Examiner* — Joshua R Beebe
(74) *Attorney, Agent, or Firm* — Keating & Bennett, LLP

(57) ABSTRACT

In a blower, an attachment portion is attached across radially outer surfaces of a first axial fan and a second axial fan connected in series. A portion of a third connecting portion of the attachment portion is connected to a first connecting portion of the first axial fan. Another portion of the third connecting portion is connected to a second connecting portion of the second axial fan. An extension portion of the attachment portion extends in an axial direction from the third connecting portion, and is located at a radially outer end of at least one of a first tubular portion and a second tubular portion. The extension portion surrounds at least one of a first lead wire and a second lead wire together with a radially outer end of at least one of the first tubular portion and the second tubular portion.

15 Claims, 8 Drawing Sheets

(56) References Cited

U.S. PATENT DOCUMENTS

2008/0286135 A1* 11/2008 Yoshida ..... F04D 29/544
417/423.5
2009/0022587 A1* 1/2009 Yoshida ..... F04D 25/166
415/213.1

* cited by examiner

BLOWER AND METHOD OF MANUFACTURING THE SAME

CROSS-REFERENCE TO RELATED APPLICATIONS

The present application claims priority under 35 U.S.C. § 119 to Japanese Patent Application No. 2022-168921, filed on Oct. 21, 2022, the entire contents of which are hereby incorporated herein by reference.

1. FIELD OF THE INVENTION

The present disclosure relates to a blower and a method of manufacturing the same.

2. BACKGROUND

Conventionally, a blower in which two axial fans are connected in an axial direction to increase the air blowing amount has been known. For example, the two axial fans are connected with a gap therebetween by latching a latching member extending from the axial fan in the subsequent stage to the latching groove. Alternatively, both are connected by a screw rod via an interval member. Further, a lead wire is drawn out from each axial fan.

Generally, the lead wire is routed outside without being covered with a protective member. Therefore, the lead wire may interfere with the connecting operation of the axial fan. In addition, when the number of lead wires increases, it becomes difficult to route a plurality of lead wires together.

SUMMARY

A blower according to an example embodiment of the present disclosure includes a first axial fan, a second axial fan, and an attachment portion. The second axial fan is connected in series to one axial side of the first axial fan. The attachment portion is attached across radially outer side surfaces of the first axial fan and the second axial fan. The first axial fan includes a first housing, a first opening, and a first connecting portion. The first housing includes a first tubular portion extending in the axial direction. The first opening is located at one axial end on the radially outer surface of the first tubular portion, and a first lead wire is drawn out from an inside of the first tubular portion. The first connecting portion is located at one axial end on the radially outer surface of the first tubular portion. The second axial fan includes a second housing, a second opening, and a second connecting portion. The second housing includes a second tubular portion extending in the axial direction. The second opening is located at another axial end on the radially outer surface of the second tubular portion, and a second lead wire is drawn out from an inside of the second tubular portion. The second connecting portion is located at the other axial end on the radially outer surface of the second tubular portion. The attachment portion includes a third connecting portion and an extension portion. A portion of the third connecting portion is connected to the first connecting portion, and another portion is connected to the second connecting portion. The extension portion extends in the axial direction from the third connecting portion, and is located at a radially outer end of at least one of the first tubular portion and the second tubular portion. The extension portion surrounds at least one of the first lead wire and the second lead wire together with a radially outer end of at least one of the first tubular portion and the second tubular portion.

A method of manufacturing a blower according to an example embodiment of the present disclosure includes hooking one end in a circumferential direction of an extension portion of an attachment portion with a first claw portion and a second claw portion located on one side in the circumferential direction of a radially outer end of at least one of a first passage and a second passage, fitting a third connecting portion having a columnar shape into a recess of each of a first connecting portion and a second connecting portion, and by sliding the attachment portion in the axial direction, hooking another end in the circumferential direction of the extension portion with a third claw portion located on the other circumferential side at an end on a side opposite to a first opening and a second opening in the axial direction, of the radially outer end of at least one of the first passage and the second passage.

The above and other elements, features, steps, characteristics and advantages of the present disclosure will become more apparent from the following detailed description of the example embodiments with reference to the attached drawings.

DETAILED DESCRIPTION

Figure 1:
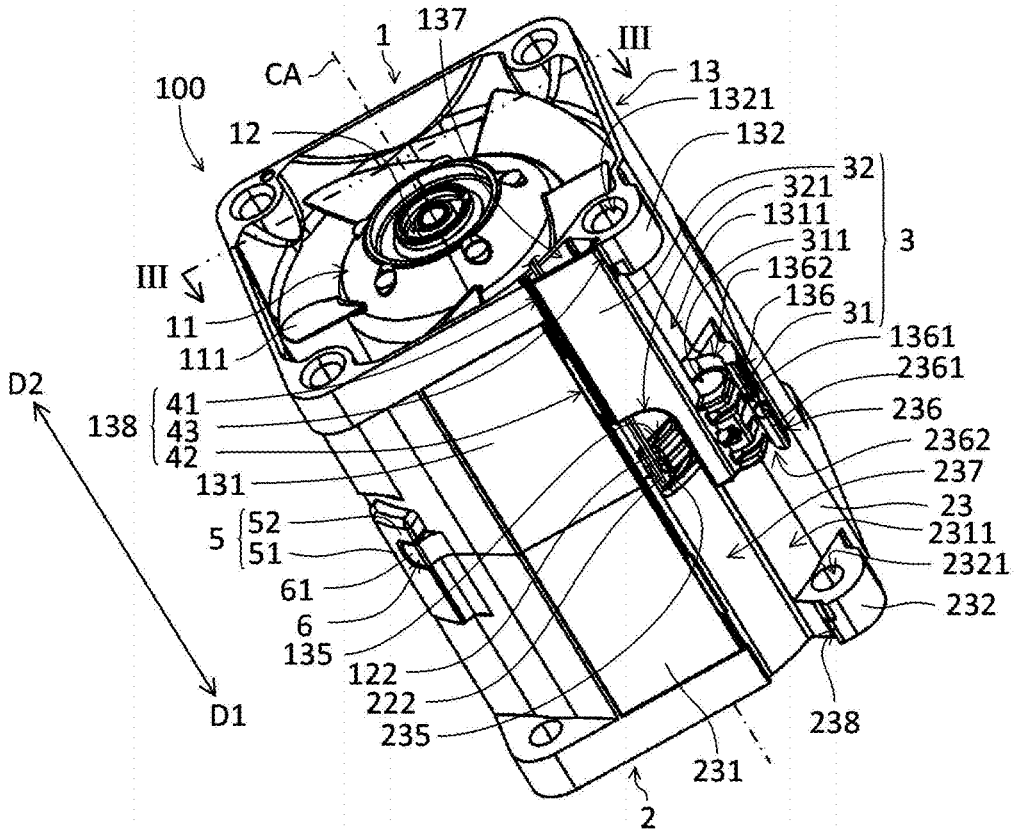
FIG. 1 is a perspective view illustrating an example of a blower according to an example embodiment of the present invention.

Example embodiments will be described with reference to the drawings hereinafter.

Note that in the present specification, in a blower 100, a direction parallel to a central axis CA is referred to as an "axial direction". Of the axial directions, a direction from a first axial fan 1 to a second axial fan 2 described later is referred to as "one axial direction", and is referred to as "D1" in the drawing. A direction from the second axial fan 2 to the first axial fan 1 is referred to as "the other axial direction", and is referred to as "D2" in the drawing. In addition, a direction orthogonal to the central axis CA is referred to as a "radial direction", and a rotational direction around the central axis CA is referred to as a "circumferential direction". In the radial directions, a direction approaching the central axis CA is referred to as "radially inward", and a direction away from the central axis CA is referred to as "radially outward".

In this specification, an "annular shape" includes not only a shape continuously connected without any cut along the entire circumference in the circumferential direction around the central axis CA, but also a shape having one or more cuts in a part of the entire circumference around the central axis CA. The "annular shape" also includes a shape having a closed curve on a curved surface that intersects with the central axis CA around the central axis CA.

In addition, in a positional relationship between any one of an azimuth, a line, and a plane and another, "parallel" includes not only a state in which both of them do not intersect at all no matter how long they extend, but also a state in which they are substantially parallel. In addition, "perpendicular" and "orthogonal" include not only a state in which both of them intersect each other at 90 degrees, but also a state in which they are substantially perpendicular and a state in which they are substantially orthogonal. In other words, each of "parallel", "perpendicular", and "orthogonal" includes a state in which the positional relationship between the two of them permits an angular deviation to a degree not departing from the spirit of the present disclosure.

It is to be noted that the above names are names used merely for description, and are not intended to limit actual positional relationships, directions, names, and the like.

Figure 2:
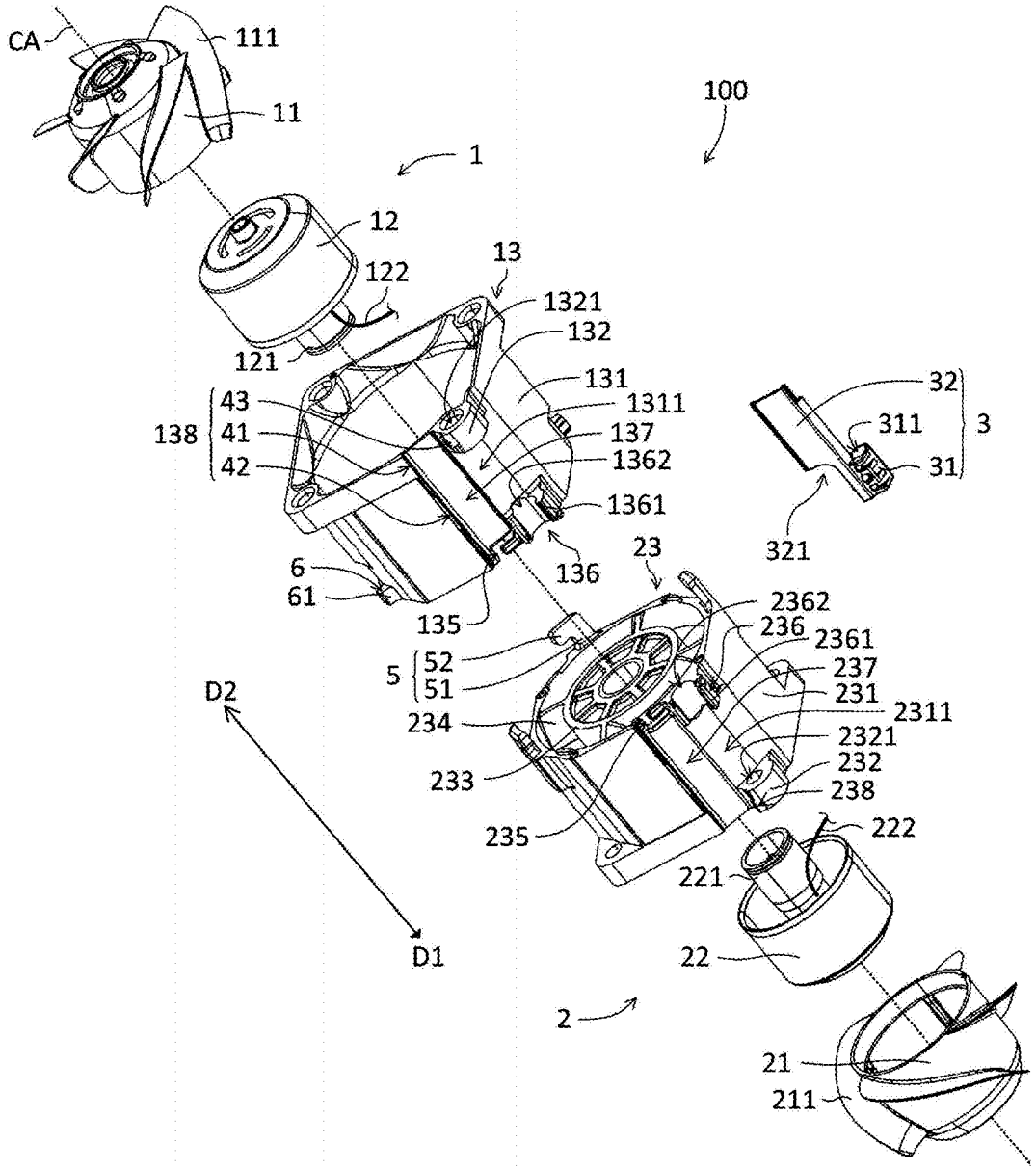
FIG. 2 is an exploded perspective view of the blower.
Figure 3:
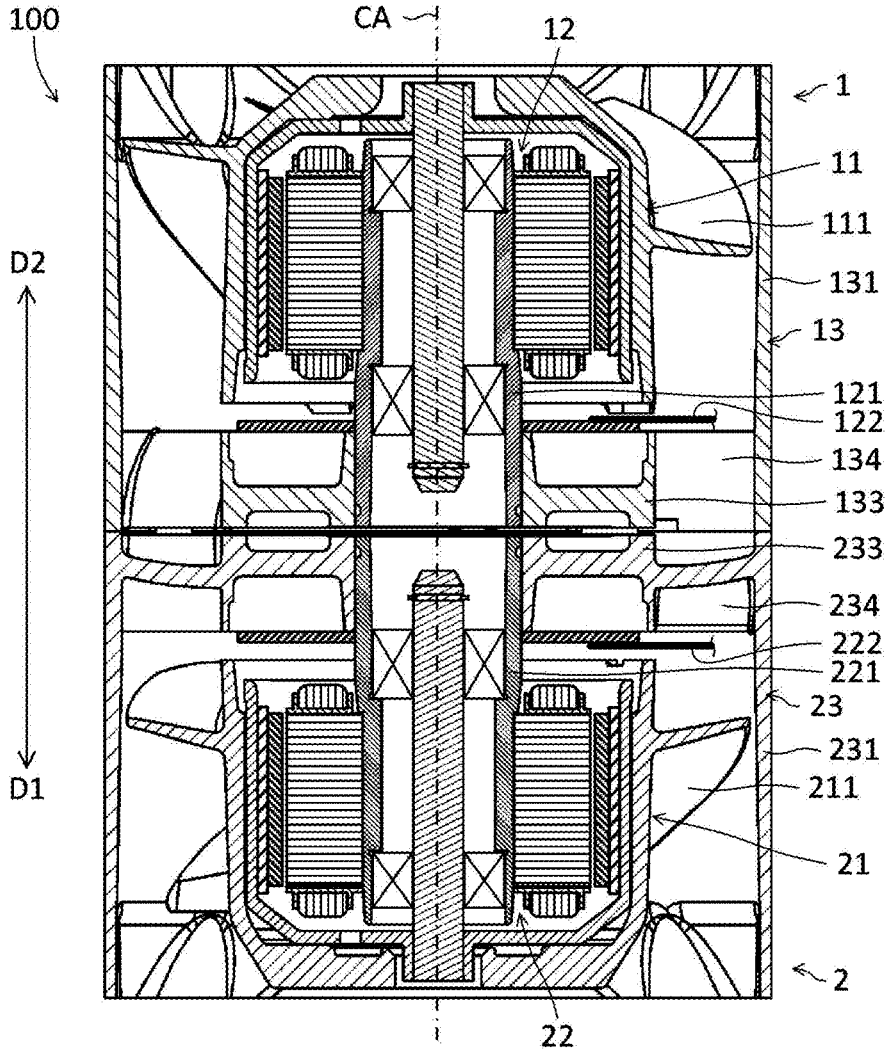
FIG. 3 is a cross-sectional view of the blower taken along an alternate long and short dash line III-III of FIG. 1.

FIG. 1 is a perspective view showing an example of the blower 100 according to an example embodiment. FIG. 2 is an exploded perspective view of the blower 100. FIG. 3 is a cross-sectional view of the blower 100 taken along an alternate long and short dash line III-III of FIG. 1. Note that FIG. 3 illustrates a sectional structure obtained by cutting the blower 100 at a virtual plane perpendicular to the axial direction.

As illustrated in FIG. 1, the blower 100 includes the first axial fan 1, the second axial fan 2, and the attachment portion 3. The second axial fan 2 is connected in series to one axial side of the first axial fan 1. The attachment portion 3 is attached across the radially outside surfaces of the first axial fan 1 and the second axial fan 2. The blower 100 further includes a hook portion 5 and a hooked portion 6 to which the hook portion 5 is hooked. The blower 100 is a serial connection fan in which the first axial fan 1 in the preceding stage and the second axial fan 2 in the subsequent stage are connected in series. The first axial fan 1 is connected to the second axial fan 2 by the attachment of the attachment portion 3 and the hooking structure of the hook portion 5 and the hooked portion 6.

The first axial fan 1 includes a first impeller 11, a first motor assembly 12, a first housing 13, and a first lead wire 122.

The first impeller 11 has a first rotor vane 111 and is rotatable about the central axis CA extending in the axial direction. As described above, the first axial fan 1 has the first impeller 11.

The first motor assembly 12 is disposed on the one axial side with respect to the first impeller 11, and drives the first impeller 11. As described above, the first axial fan 1 includes the first motor assembly 12. As a result, the first axial fan 1 sucks air from the suction port at the other axial end. The first axial fan 1 generates an airflow flowing in one axial direction, and sends out the airflow from an exhaust port at one axial end.

The first motor assembly 12 includes the first lead wire 122. The first lead wire 122 connects the first motor assembly 12 and an external device (power supply or the like). The first lead wire 122 extends from the first motor assembly 12 and is drawn out of the first axial fan 1. The first lead wire 122 may be singular or plural.

The first housing 13 includes a first tubular portion 131, a first flange 132, a first bracket 133, a first rib 134, a first opening 135, a first connecting portion 136, a first passage 137, and a claw portion 138. That is, the first axial fan 1 of the blower 100 includes these components.

The first tubular portion 131 has a tubular shape extending in the axial direction. As described above, the first axial fan 1 includes the first housing 13, and the first housing 13 includes the first tubular portion 131. In the present example embodiment, the outer shape of the first tubular portion 131 as viewed from the axial direction is a polygonal shape having n pieces (n is a natural number of 4 or more) of corner portions. In the present example embodiment, the outer shape of the first tubular portion 131 as viewed from the axial direction is a rectangular shape in which four corner portions are C-chamfered. The C-chamfered surface 1311 of the corner portion extends from one axial end to the other axial end of the first tubular portion 131. The first tubular portion 131 accommodates therein the first impeller 11, the first motor assembly 12, the first bracket 133, and the first rib 134. The first tubular portion 131 forms a wind tunnel that extends in the axial direction and through which an airflow communicates between the first impeller 11 and the first bracket 133.

The first flange 132 expands radially outward from the other axial end of the first tubular portion 131. The first flange 132 expands radially outward from the other axial end of the C-chamfered surface 1311 at each corner portion when viewed from the axial direction of the first tubular portion 131. The first flange also 132 has a through hole 1321. The through hole 1321 is an example of a "first through hole" of the present disclosure, extends in the axial direction, and penetrates the first flange 132. The present disclosure is not limited to the example of the present example embodiment, and the first flange 132 and the through hole 1321 may be omitted.

The first bracket 133 has an annular shape surrounding the central axis CA, holds the first motor assembly 12, and particularly holds one axial end of a stator holder 121 (see FIG. 3 and the like).

The first rib 134 is disposed at one axial end of the space between the first tubular portion 131 and the first bracket 133, and connects them. A radially inner end of the first rib 134 is connected to the first bracket 133 and supports the first bracket 133. The radially outer end of the first rib 134 is connected to the first tubular portion 131. The first rib 134 has an airfoil shape and functions as a stator vane that rectifies an airflow flowing in the wind tunnel. For example, the first rib 134 extends in the circumferential direction toward one axial side. However, this example does not exclude a configuration in which the first rib 134 does not have an airfoil shape.

The first opening 135 is disposed at one axial end on the radially outer surface of the first tubular portion 131. The first lead wire 122 is drawn out from the inside of the first tubular portion 131 to the outside through the first opening 135. As described above, the first axial fan 1 includes the first opening 135. The first opening 135 communicates from the inside to the outside of the first tubular portion 131.

The first passage 137 is disposed in the first tubular portion 131, and extends from the first opening 135 at least toward the other axial side. Preferably, the circumferential position range of the first passage 137 overlaps the circumferential position range of at least one of the first opening 135 and the second opening 235 to be described later. In the present example embodiment, the first passage 137 is disposed on one circumferential side with respect to the one first flange 132, is recessed radially inward, and extends from the first opening 135 to the other axial end of the first tubular portion 131. However, this example does not exclude a configuration in which the circumferential position range of the first passage 137 does not overlap the circumferential position ranges of both the first opening 135 and the second opening 235.

The first passage 137 can accommodate at least one of the first lead wire 122 and the second lead wire 222 to be described later. That is, at least one of the first lead wire 122 drawn out from the first opening 135 and the second lead wire 222 drawn out from the second opening 235 can be housed in the first passage 137 and wired to the other axial side.

The radially outer end of the first passage 137 has the claw portion 138. The claw portion 138 hooks a circumferential end of an extension portion 32, described later, of the attachment portion 3. The claw portion 138 protrudes inward from the radially outer end of the first passage 137 (that is, an outer edge of the opening portion).

Note that the example of the present example embodiment does not exclude a configuration in which the first passage 137 is omitted. In this case, the claw portion 138 is disposed on the radially outer surface of the first tubular portion 131 in a form capable of hooking the circumferential end of the extension portion 32.

The first connecting portion 136 is disposed at one axial end on the radially outer surface of the first tubular portion 131. As described above, the first axial fan 1 includes the first connecting portion 136.

The first connecting portion 136 has a first peripheral wall portion 1361. The first peripheral wall portion 1361 protrudes radially outward from the first tubular portion 131 and extends in the axial direction. In the present example embodiment, the first connecting portion 136 is disposed adjacent to the other circumferential side of the first opening 135. The pair of first connecting portions 136 is arranged in the circumferential direction. The radial length of the first peripheral wall portion 1361 on the other circumferential side is longer than the first peripheral wall portion 1361 on the one circumferential side (that is, the first opening 135 side).

The first connecting portion 136 has a first recess 1362. Specifically, the first peripheral wall portion 1361 constitutes the first recess 1362. The first recess 1362 is open in the radial direction and the axial direction, and can be fitted to a third connecting portion 31, described later, of the attachment portion 3 in the axial direction. In the present example embodiment, the first recess 1362 is disposed between the pair of first peripheral wall portions 1361, and is recessed radially inward.

The present disclosure is not limited to the above example, and the first peripheral wall portions 1361 may not be paired. For example, the first peripheral wall portion 1361 on the first opening 135 side may be omitted. In this case, the first recess 1362 is formed of one (the other circumferential side) first peripheral wall portion 1361 so that the third connecting portion 31 can be fitted.

The second axial fan 2 includes a second impeller 21, a second motor assembly 22, a second housing 23, and a second lead wire 222.

The second impeller 21 has a second rotor vane 211 and is rotatable about the central axis CA extending in the axial direction. As described above, the second axial fan 2 includes the second impeller 21.

The second motor assembly 22 is disposed on the other axial side with respect to the second impeller 21, and drives the second impeller 21. As described above, the second axial fan 2 includes the second motor assembly 22. As a result, the second axial fan 2 sucks and accelerates the airflow delivered from the first axial fan 1 at the suction port at the other axial end, and delivers the airflow from the exhaust port at one axial end.

The second motor assembly 22 includes the second lead wire 222. The second lead wire 222 connects the second motor assembly 22 and an external device (power supply or the like). The second lead wire 222 extends from the second motor assembly 22 and is drawn out of the second axial fan 2. The second lead wire 222 may be singular or plural.

The second housing 23 includes a second tubular portion 231, a second flange 232, a second bracket 233, a second rib 234, a second opening 235, a second connecting portion 236, a second passage 237, and a claw portion 238. That is, the second axial fan 2 of the blower 100 includes these components.

The second tubular portion 231 has a tubular shape extending in the axial direction. As described above, the second axial fan 2 has the second housing 23, and the second housing 23 has the second tubular portion 231. In the present example embodiment, the outer shape of the second tubular portion 231 as viewed from the axial direction is a polygonal shape having n pieces (n is a natural number of 4 or more) of corner portions. Specifically, the outer shape of the second tubular portion 231 as viewed from the axial direction is a rectangular shape in which four corner portions are C-chamfered. The C-chamfered surface 2311 of the corner portion extends from one axial end to the other axial end of the second tubular portion 231. The second tubular portion 231 accommodates therein the second impeller 21, the second motor assembly 22, the second bracket 233, and the second rib 234. The second tubular portion 231 forms a wind tunnel that extends in the axial direction and through which an airflow communicates between the second impeller 21 and the second bracket 233. The other axial end of the second tubular portion 231 is in contact with one axial end of the first tubular portion 131 of the second axial fan 2.

In the blower 100, the first motor assembly 12 and the second motor assembly 22 can be disposed close to each other in the axial direction. Therefore, in the first tubular portion 131 and the second tubular portion 231, the first lead wire 122 and the second lead wire 222 respectively drawn out from the first tubular portion and the second tubular portion can be collectively bundled and protected. Therefore, the first lead wire 122 and the second lead wire 222 are easily drawn.

The second flange 232 expands radially outward from one axial end of the second tubular portion 231. The second flange 232 expands radially outward from the other axial end of the C-chamfered surface 2311 at each corner portion when viewed from the axial direction of the second tubular portion 231. The second flange 232 has a through hole 2321. The through hole 2321 is another example of a "first through hole" of the present disclosure, extends in the axial direction, and penetrates the second flange 232. Note that the present disclosure is not limited to the example of the present example embodiment, and the second flange 232 and the through hole 2321 may be omitted. However, preferably, the blower 100 includes at least one of the first flange 132 (and the through hole 1321) and the second flange 232 (and the through hole 2321).

The second bracket 233 has an annular shape surrounding the central axis CA, holds the second motor assembly 22, and particularly holds one axial end of a stator holder 221 thereof (see FIG. 3 and the like). The other axial end of the second bracket 233 may face the one axial end of the first bracket 133 of the first motor assembly 12 in the axial direction with a gap therebetween, or may be in contact with the one axial end of the first bracket 133.

The second rib 234 is disposed at the other axial end of the space between the second tubular portion 231 and the second bracket 233, and connects them. A radially inner end of the second rib 234 is connected to the second bracket 233 and supports the second bracket 233. The radially outer end of the second rib 234 is connected to the second tubular portion 231. The second rib 234 has an airfoil shape and functions as a stator vane that rectifies an airflow flowing in the wind tunnel. For example, the second rib 234 extends in the circumferential direction toward one axial side. However, this example does not exclude a configuration in which the second rib 234 does not have an airfoil shape.

Preferably, the circumferential position of the other axial end of the second rib 234 overlaps the circumferential position of one axial end of the first rib 134. For example, the other axial end of the second rib 234 may be in contact with one axial end of the first rib 134, or may face the one axial end of the first rib 134 in the axial direction with a gap. More preferably, the first rib 134 and the second rib 234 overlapping in the axial direction function as a single stator vane. For example, the second rib 234 extends in the same circumferential direction as the first rib 134 toward one side in the axial direction. In this way, it is possible to enhance the rectifying effect of the airflow flowing in the wind tunnel of the first axial fan 1 and the second axial fan 2 while reducing the air resistance of the first rib 134 and the second rib 234.

The second opening 235 is disposed at the other axial end on the radially outer surface of the second tubular portion 231. The second lead wire 222 is drawn out from the inside to the outside of the second tubular portion 231 through the second opening 235. As described above, the second axial fan 2 has the second opening 235. The second opening 235 communicates from the inside to the outside of the second tubular portion 231. The circumferential position of the second opening 235 preferably overlaps, and more preferably coincides with, the circumferential position of the first opening 135. Consequently, the second opening 235 through which the second lead wire 222 is drawn can be disposed near the first opening 135 through which first lead wire 122 is drawn. Therefore, the first lead wire 122 and the second lead wire 222 can be easily bundled, and can be handled as a set of lead wire group, for example.

The second passage 237 is disposed in the second tubular portion 231, and extends at least in one axial direction from the second opening 235. Preferably, the circumferential position range of the second passage 237 overlaps the circumferential position range of at least one of the first opening 135 and the second opening 235. In the present example embodiment, the second passage 237 is disposed on one circumferential side with respect to the one second flange 232, is recessed radially inward, and extends from the second opening 235 to one axial end of the second tubular portion 231. However, this example does not exclude a configuration in which the circumferential position range of the second passage 237 does not overlap the circumferential position ranges of both the first opening 135 and the second opening 235.

However, preferably, the circumferential position range in which at least one of the first passage 137 and the second passage 237 is disposed overlaps the circumferential position range in which at least one of the first opening 135 and the second opening 235 is disposed. Thus, for example, each of the lead wires 122 and 222 drawn out from each of the openings 135 and 235 can be passed through at least one of the first passage 137 and the second passage 237 by extending in the axial direction as it is. Therefore, each of the lead wires 122 and 222 can be easily drawn out.

The second passage 237 can accommodate at least one of the first lead wire 122 and the second lead wire 222. That is, at least one of the first lead wire 122 drawn out from the first opening 135 and the second lead wire 222 drawn out from the second opening 235 can be accommodated in the first passage 137 and wired to one axial side.

The radially outer end of the second passage 237 has the claw portion 238. The claw portion 238 protrudes inward from the radially outer end of the second passage 237 (that is, an outer edge of the opening portion).

Note that the example of the present example embodiment does not exclude a configuration in which the second passage 237 is omitted. In this case, the claw portion 238 is disposed on the radially outer surface of the second tubular portion 231 in a form capable of hooking the circumferential end of the extension portion 32. However, preferably, the blower 100 includes at least one of the first passage 137 and the second passage 237.

The second connecting portion 236 is disposed at the other axial end on the radially outer surface of the second tubular portion 231. As described above, the second axial fan 2 includes the second connecting portion 236. Preferably, the first connecting portion 136 and the second connecting portion 236 are disposed at corner portions of the first tubular portion 131 and the second tubular portion 231 as viewed in the axial direction. In other words, each of the connecting portions 136 and 236 is not disposed on a side portion of each of the tubular portions 131 and 231 as viewed in the axial direction, but is disposed at a C-chamfered corner portion, for example. In this way, each of the connecting portions 136 and 236 can be easily disposed. In addition, since an increase in the radial size of each of the housings 13 and 23 can be prevented, the blower 100 can be made compact. However, this example does not exclude a configuration in which each of the connecting portions 136 and 236 is disposed on a side portion as viewed from the axial direction of each of the tubular portions 131 and 231.

The second connecting portion 236 has a second peripheral wall portion 2361. The second peripheral wall portion 2361 protrudes radially outward from the second tubular portion 231 and extends in the axial direction. In the present example embodiment, the second connecting portion 236 is disposed adjacent to the other circumferential side of the second opening 235. The pair of second connecting portions 236 is arranged in the circumferential direction. The radial length of the second peripheral wall portion 2361 on the other circumferential side is longer than the second peripheral wall portion 2361 on the one circumferential side (that is, the second opening 235 side).

The second connecting portion 236 has a second recess 2362. Specifically, the second peripheral wall portion 2361 constitutes the second recess 2362. The second recess 2362 is open in the radial direction and the axial direction, and can be fitted to the third connecting portion 31 of the attachment portion 3 in the axial direction. In the present example embodiment, the second recess 2362 is disposed between the pair of second peripheral wall portions 2361, and is recessed radially inward.

With such a configuration, by fitting the third connecting portion 31 of the attachment portion 3 into the first recess 1362 and the second recess 2362, the third connecting portion 31 can be easily connected to the first connecting portion 136 and the second connecting portion 236. In addition, since the first peripheral wall portion 1361 and the second peripheral wall portion 2361 extend along the circumferential end of the third connecting portion 31, the third connecting portion 31 can be positioned in the circumferential direction, and the circumferential movement of one of the first housing 13 and the second housing 23 with respect to the other of the first housing 13 and the second housing 23 can be prevented.

The present disclosure is not limited to the above example, and the second peripheral wall portions 2361 may not be paired. For example, the second peripheral wall portion 2361 on the second opening 235 side may be omitted. In this case, the second recess 2362 is formed of one (the other circumferential side) second peripheral wall portion 2361 so that the third connecting portion 31 can be fitted.

The attachment portion 3 connects the axial fans 1 and 2 in series, and protects the lead wires 122 and 222 drawn out in the axial direction. The attachment portion 3 includes the third connecting portion 31 and the extension portion 32.

The third connecting portion 31 has a columnar shape extending in the axial direction. A part (for example, a portion on one axial side) of the third connecting portion 31 is connected to the first connecting portion 136. Another part (for example, a portion on the other axial side) of the third connecting portion 31 is connected to the second connecting portion 236.

The third connecting portion 31 has a through hole 311. The through hole 311 extending in the axial direction is an example of a "second through hole" of the present disclosure, extends in the axial direction and penetrates the third connecting portion 31. Preferably, the through hole 311 overlaps the through holes 1321 and 2321 of the first flange 132 and the second flange 232 when viewed from the axial direction. In this way, it is possible to prevent the third connecting portion 31 from interfering when rod-shaped members pass through the through holes 1321 and 2321. For example, the blower 100 can be fixed by inserting bolts or the like into the through holes 1321 and 2321 and the through hole 311.

The extension portion 32 extends in the axial direction from the third connecting portion 31, and is disposed at the radially outer end of at least one of the first tubular portion 131 and the second tubular portion 231. The extension portion 32 surrounds at least one of the first lead wire 122 and the second lead wire 222 together with at least one of the first tubular portion 131 and the second tubular portion 231.

With the above configuration, when the attachment portion 3 is attached to the first axial fan 1 and the second axial fan 2, the third connecting portion 31 is connected to each of the first connecting portion 136 and the second connecting portion 236. Furthermore, at this time, at least one of the first lead wire 122 and the second lead wire 222 is surrounded by the above-described at least one of the passages 137 and 237 and the extension portion 32. In other words, at least one of the lead wires 122 and 222 is accommodated in a space formed by at least one of the first tubular portion 131 and the second tubular portion 231 and the extension portion 32. Therefore, by attaching the attachment portion 3, it is possible to easily perform series connection of the first axial fan 1 and the second axial fan 2 and extraction of at least one of the first lead wire 122 and the second lead wire 222 in the axial direction.

Specifically, the extension portion 32 surrounds at least one of the first lead wire 122 and the second lead wire 222 together with at least one of the first passage 137 and the second passage 237. In this way, a space for accommodating at least one of the first lead wire 122 and the second lead wire 222 and passing the same in the axial direction can be disposed in at least one of the first tubular portion 131 and the second tubular portion 231. Therefore, each of the lead wires 122 and 222 can be easily drawn out in the axial direction.

In the present example embodiment, as illustrated in FIG. 1, one extension portion 32 extends from the third connecting portion 31 in the other axial direction and is hooked to the radially outer end of the first passage 137 by the claw portion 138. The extension portion 32 can surround the lead wire 122 or 222 housed in the first passage 137 together with the first passage 137. In the present example embodiment, the extension portion 32 is not hooked to the second passage 237. In this case, the claw portion 238 of the second passage 237 may be omitted.

Figure 4A:
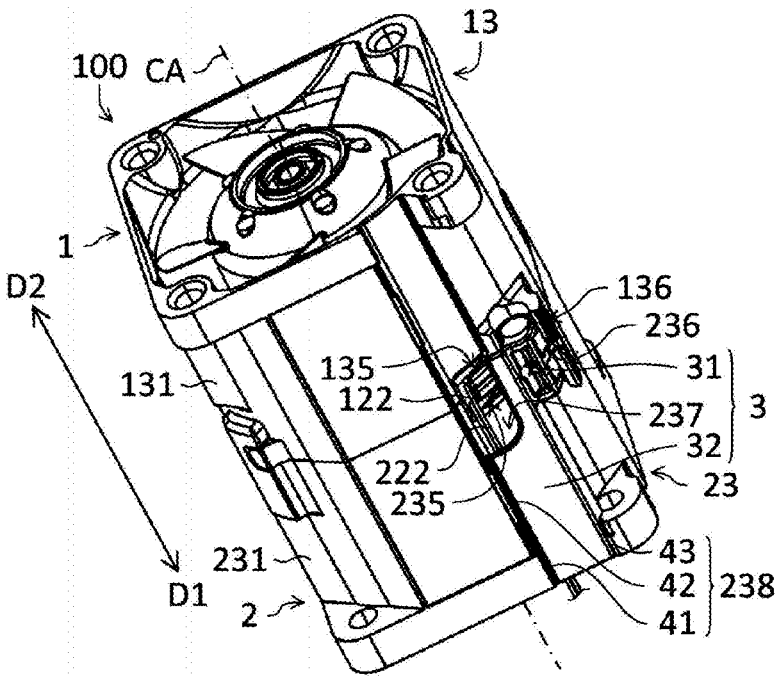
FIG. 4A is a perspective view of a first modification of an attachment portion according to an example embodiment of the present invention.

However, the extension portion 32 is not limited to the example of the present example embodiment. For example, as illustrated in FIG. 4A, one extension portion 32 may extend in one axial direction from the third connecting portion 31 and be disposed at the radially outer end of the second passage 237. In this case, the extension portion 32 is hooked to the radially outer end of the second passage 237 by the claw portion 238. The extension portion 32 can surround the lead wire 122 or 222 housed in the second passage 237 together with the second passage 237. However, in FIG. 4A, since the extension portion 32 is not hooked to the first passage 137, the claw portion 138 of the first passage 137 may be omitted.

Figure 4B:
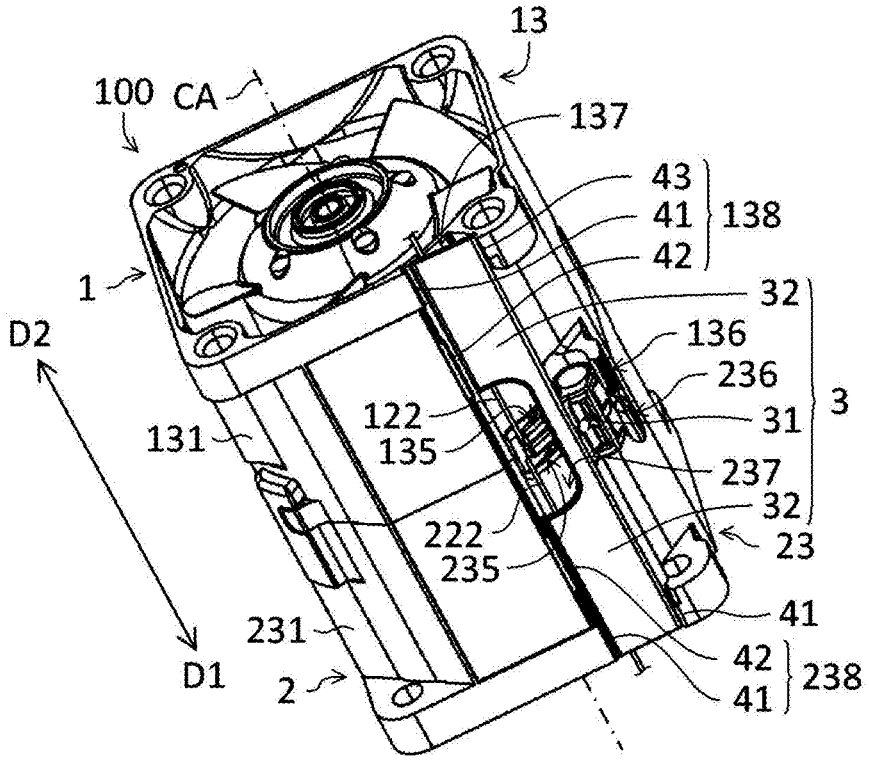
FIG. 4B is a perspective view of a second modification of an attachment portion according to an example embodiment of the present invention.

Alternatively, as illustrated in FIG. 4B, the number of the extension portions 32 may be two, and the extension portions may extend from the third connecting portion 31 to one side and the other side in the axial direction, and may be disposed at the radially outer ends of the first passage 137 and the second passage 237, respectively. In this case, the extension portion 32 is hooked to the radially outer end of the first passage 137 by the claw portion 138. The extension portion 32 on one side in the axial direction is hooked to the radially outer end of the second passage 237 by the claw portion 238. The first lead wire 122 and the second lead wire 222 can be accommodated in either the first passage 137 or the second passage 237. One of the first lead wire 122 and the second lead wire 222 can be accommodated in the first passage 137, and the other can be accommodated in the second passage 237.

As described above, the radially outer end of at least one of the first passage 137 and the second passage 237 has the above-described claw portion 138 or 238 for hooking the circumferential end of the extension portion 32. At least one of the first passage 137 and the second passage 237 is one of the first passage 137 and the second passage 237 on which the extension portion 32 is hooked. The claw portion 138 or 238 is a claw portion disposed in at least one of the first passage 137 and the second passage 237 out of the claw portion 138 and the claw portion 238. By hooking the circumferential end of the extension portion 32 with the claw portion 138 or 238 described above, it is possible to prevent the extension portion 32 from being separated radially outward from at least one of the first passage 137 and the second passage 237 (that is, the passage accommodating at least one of the first lead wire 122 and the second lead wire 222). Therefore, the lead wires 122 and 222 drawn out in the axial direction can be sufficiently held.

Each of the claw portions 138 and 238 includes a first claw portion 41, a second claw portion 42, and a third claw portion 43.

The first claw portion 41 is disposed at an end of at least one of the radial outer ends of the first passage 137 and the second passage 237 on the side opposite to the first opening 135 and the second opening 235 in the axial direction. In the present example embodiment, the first claw portion 41 is disposed in both the first passage 137 and the second passage 237. Specifically, the first claw portion 41 on the first passage 137 side is disposed at one end in the circumferential direction (that is, on the side opposite to the first flange 132) of the radially outer end of the first passage 137, and extends in the axial direction. For example, the first claw portion 41 on the first passage 137 side is disposed at the other axial end of the first passage 137. The first claw portion 41 on the second passage 237 side is disposed at one end in the circumferential direction (that is, on the side opposite to the second flange 232) of the radially outer end of the second passage 237, and extends in the axial direction. For example, the first claw portion 41 on the second passage 237 side is disposed at the other axial end of the second passage 237.

The second claw portion 42 is disposed away from the first claw portion 41 of the radially outer end of at least one of the first passage 137 and the second passage 237 toward the first opening 135 and the second opening 235 side in the axial direction. In the present example embodiment, the second claw portion 42 is disposed in both the first passage 137 and the second passage 237. Specifically, the second claw portion 42 on the first passage 137 side is disposed away from the first claw portion 41 on the first passage 137 side in one axial direction at one circumferential end of the radially outer end of the second passage 237, and extends in the axial direction. Further, the second claw portion 42 on the second passage 237 side is disposed away from the first claw portion 41 on the second passage 237 side in the other axial direction at one circumferential end of the radially outer end of the second passage 237, and extends in the axial direction.

Figure 5:
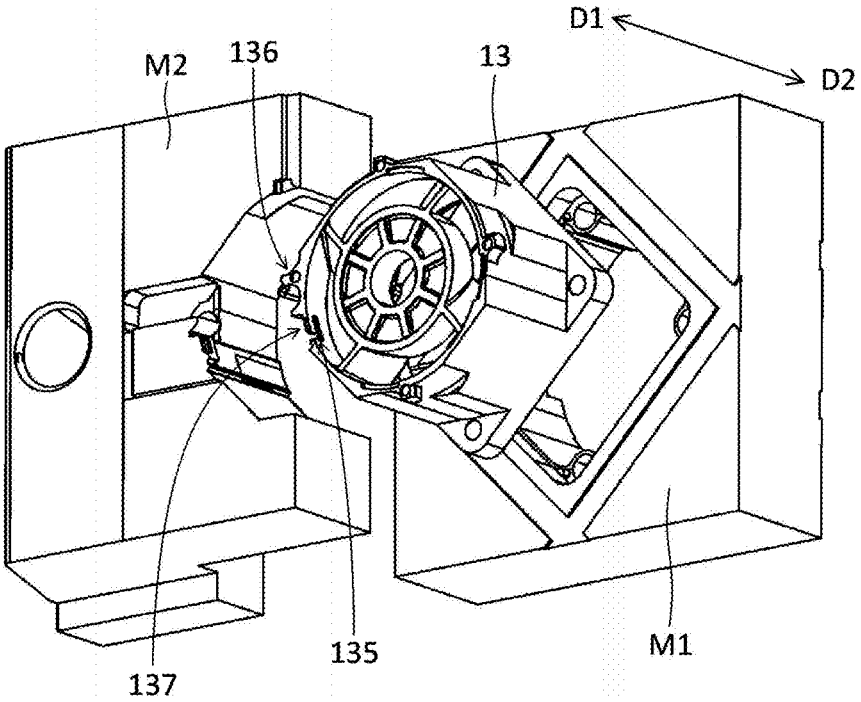
FIG. 5 is a perspective view illustrating an example of die molding of the first housing.

In this way, the first claw portion 41 and the second claw portion 42 are separated from each other in the axial direction to further shorten the axial length thereof. As a result, for example, as illustrated in FIG. 5, when the housings 13 and 23 having at least one of the first passage 137 and the second passage 237 are molded, the first claw portion 41 can be formed by separating a first mold M1 in the axial direction. On the other hand, the second claw portion 42 can be formed by separating a second mold M2 in the radial direction. Although FIG. 5 illustrates an example of molding of the first housing 13, the second housing 23 can also be molded as in FIG. 5. Therefore, as compared with the case where the first claw portion 41 and the second claw portion 42 are connected in the axial direction, the claw portions 138 and 238 can be formed without using a core to be pulled out in the axial direction for a mold. Therefore, it is easy to mold, and the productivity of the blower 100 can be improved.

In addition, the first claw portion 41 and the second claw portion 42 are separated in the axial direction. Therefore, if the hooking portion of the extension portion 32 is set to be shorter than the length between the two, the hooking portion can be inserted from between the two and slid in the axial direction together with the third connecting portion 31 fitted to the first connecting portion 136 and the second connecting portion 236, whereby the extension portion 32 can be hooked to the claw portion 138.

The third claw portion 43 is disposed to face the first claw portion 41 in the circumferential direction at an end of at least one of the radial outer ends of the first passage 137 and the second passage 237 on the side opposite to the first opening 135 and the second opening 235 in the axial direction. In the present example embodiment, the third claw portion 43 is disposed in both the first passage 137 and the second passage 237. Specifically, the third claw portion 43 on the first passage 137 side is disposed at the other circumferential end (that is, on the first flange 132 side) of the radially outer end of the first passage 137, and extends in the axial direction. For example, the third claw portion 43 is disposed at the other axial end of the first passage 137. The third claw portion 43 on the second passage 237 side is disposed at the other circumferential end (that is, the second flange 232 side) of the radially outer end of the second passage 237, and extends in the axial direction. For example, the third claw portion 43 is disposed at the other axial end of the second passage 237.

The third claw portion 43 is provided with a notch on the first opening 135 and the second opening 235 side in the axial direction. As will be described later, the notch functions as a guide for positioning the attachment portion 3 in the axial direction and sliding the attachment portion 3 when the attachment portion 3 is attached. Further, due to this notch, the axial length of the third claw portion 43 is shorter than that of the first claw portion 41. The ends of the third claw portion 43 on the first opening 135 and the second opening 235 side in the axial direction are disposed on the opposite side to the first opening 135 and the second opening 235 in the axial direction from the ends of the first claw portion 41 on the first opening 135 and the second opening 235 side in the axial direction.

Preferably, the extension portion 32 has a plate shape radially facing the radially outer end of at least one of the first tubular portion 131 and the second tubular portion 231. In the present example embodiment, the plate-shaped extension portion 32 faces the first passage 137 in the radial direction. However, the present disclosure is not limited to the example of the present example embodiment, and the plate-shaped extension portion 32 may face the second passage 237 in the radial direction. Accordingly, the circumferential width of the space surrounding at least one of the first lead wire 122 and the second lead wire 222 can be further increased. Therefore, the number of the lead wires 122 and 222 that can be surrounded by at least one of the first tubular portion 131 and the second tubular portion 231 and the extension portion 32 can be further increased.

Preferably, the extension portion 32 has a notch 321. The notch 321 exposes at least one of the first opening 135 and the second opening 235 to the outside when viewed from the radial direction. For example, the notch 321 is a recess disposed at an end of the extension portion 32 on the openings 135 and 235 side in the axial direction, and extends in the axial direction and the circumferential direction to penetrate the extension portion 32. In the present example embodiment, the notch 321 exposes both the first opening 135 and the second opening 235 to the outside when viewed from the radial direction. By having the notch 321, it is possible to prevent at least one of the first opening 135 and the second opening 235 from being covered with the extension portion 32. Accordingly, the lead wires 122 and 222 drawn from the respective openings 135 and 235 can be largely bent and extended in the axial direction. Accordingly, disconnection due to breakage of the lead wires 122 and 222 near the openings 135 and 235 can be prevented. Further, for example, at least a part of the lead wires 122 and 222 can be drawn out in the radial direction from at least one of the first opening 135 and the second opening 235. That is, it is possible to increase the number of drawing units of the lead wires 122 and 222. However, this example does not exclude a configuration in which the extension portion 32 does not have the notch 321.

The hook portion 5 protrudes in the axial direction from one of the first tubular portion 131 and the second tubular portion 231 toward the other. The hooked portion 6 is disposed on the other of the first tubular portion 131 and the second tubular portion 231. The hook portion 5 is hooked to the hooked portion 6 in the axial direction. As described above, the blower 100 includes the hook portion 5 and the hooked portion 6. In the present example embodiment, the hook portion 5 protrudes in the other axial direction from the other axial end of the C-chamfered surface 2311 where the second connecting portion 236 is not disposed in the second tubular portion 231. The hooked portion 6 is disposed at one axial end of the C-chamfered surface 1311 where the first connecting portion 136 is not disposed in the first tubular portion 131. Thus, the first axial fan 1 and the second axial fan 2 can be easily and reliably connected by hooking the hook portion 5 and the hooked portion 6 and connecting the first connecting portion 136 and the second connecting portion 236 to the third connecting portion 31.

The hook portion 5 includes a column portion 51 and a hooking portion 52. The column portion 51 extends in the axial direction from one of the first tubular portion 131 and the second tubular portion 231. The hooking portion 52 extends in at least one of the circumferential direction and the radial direction from a portion on the other side of the first tubular portion 131 and the second tubular portion 231 in the axial direction of the column portion 51. In the present example embodiment, the column portion 51 extends in the other axial direction from the other axial end of the second tubular portion 231. The hooking portion 52 extends in the other circumferential direction from a part on the other side in the axial direction of the column portion 51.

Preferably, (the column portion 51 of) the hook portion 5 is in contact with the hooked portion 6 in the circumferential direction. This facilitates circumferential positioning of the hook portion 5 with respect to the hooked portion 6. Further, by bringing the hook portion 5 and the hooked portion 6 into contact with each other in the circumferential direction, it is possible to prevent the hook portion 5 and the hooked portion 6 from being easily detached from each other.

More preferably, the column portion 51 is disposed adjacent to the hooked portion 6 on one side in the circumferential direction. With such a configuration, before the attachment portion 3 is attached, by rotating the second axial fan 2 in the other circumferential direction with respect to the first axial fan 1, the hook portion 5 can be hooked to the hooked portion 6, and the second axial fan 2 can be connected to the first axial fan 1. After the attachment portion 3 is attached, the rotation of the second axial fan 2 in the other circumferential direction with respect to the first axial fan 1 is suppressed by the connection between the first connecting portion 136 and the second connecting portion 236, and the third connecting portion 31. In particular, the first peripheral wall portion 1361 of the first connecting portion 136 and the second peripheral wall portion 2361 of the second connecting portion 236 are in contact with the other circumferential end of the third connecting portion 31. As a result, the second axial fan 2 is further less likely to rotate in the other circumferential direction with respect to the first axial fan 1. Therefore, rotation of the second axial fan 2 in the circumferential direction with respect to the first axial fan 1 is realized.

In the present example embodiment, the hooked portion 6 has either a protrusion 61 or a recess. The protrusion 61 protrudes radially outward from the other radially outer end surface of the first tubular portion 131 and the second tubular portion 231, and is disposed on one side of either the first tubular portion 131 or the second tubular portion 231 in the axial direction with respect to the hooking portion 52. The recess is disposed on the other radially outer end surface of the first tubular portion 131 and the second tubular portion 231, and is recessed in at least one of the circumferential direction and the radial direction. For example, in the present example embodiment, the hooked portion 6 has a protrusion 61. The protrusion 61 protrudes radially outward from the radially outer end surface of the first tubular portion 131, and is disposed on one side in the axial direction with respect to the hooking portion 52. As a result, the hooking portion 52 is hooked to the protrusion 61. When the hooked portion 6 has a recess, the hooking portion 52 is fitted into the recess. Accordingly, the hook portion 5 can be hooked to the hooked portion 6 by hooking the hooking portion 52 and the protrusion 61 or fitting the hooking portion 52 to the recess.

Preferably, the hook portion 5 and the hooked portion 6 are disposed at corner portions of the first tubular portion 131 and the second tubular portion 231 as viewed in the axial direction. In other words, the hook portion 5 and the hooked portion 6 are not disposed on the side portion as viewed in the axial direction of each of the tubular portions 131 and 231, but are disposed, for example, at C-chamfered corner portions. In this way, the hook portion 5 and the hooked portion 6 can be easily disposed. In addition, since an increase in the radial size of each of the housings 13 and 23 can be prevented, the blower 100 can be made compact. However, this example does not exclude a configuration in which the hook portion 5 and the hooked portion 6 are arranged on the side portions of the respective tubular portions 131 and 231 as viewed from the axial direction.

Figure 6:
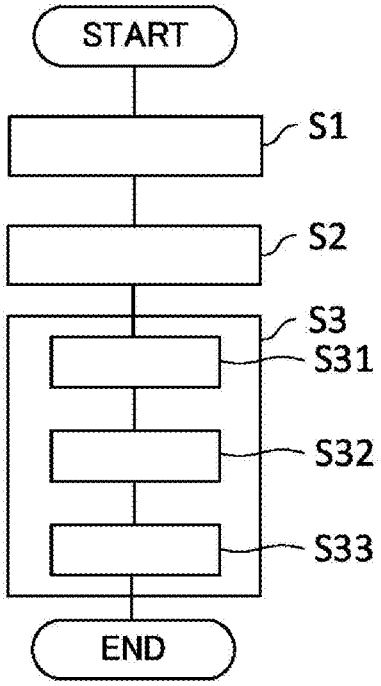
FIG. 6 is a flowchart to explain an example of a method of manufacturing a blower according to an example embodiment of the present invention.
Figure 7A:
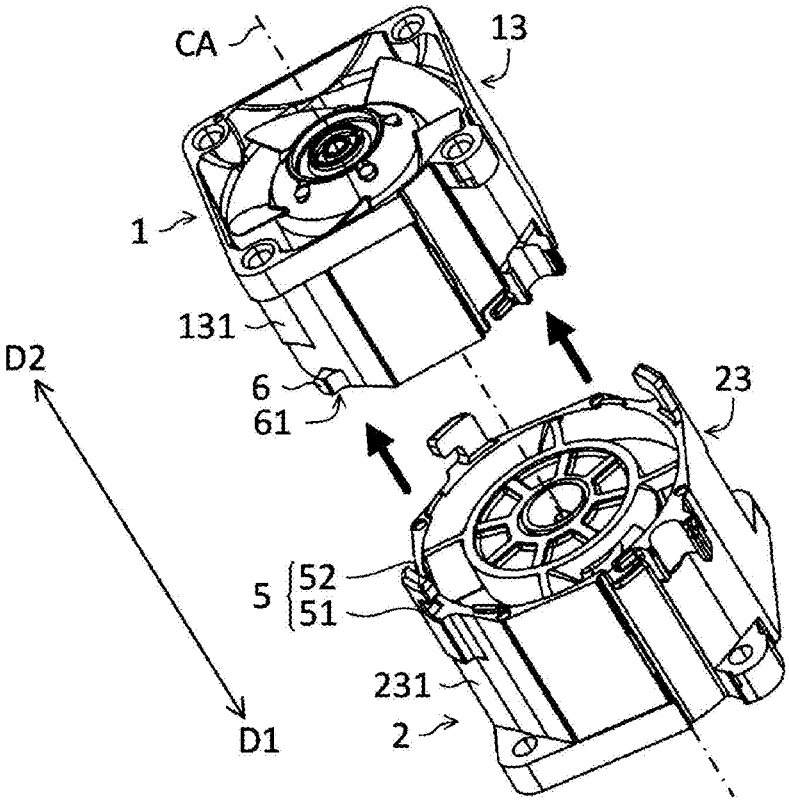
FIG. 7A is a perspective view of a first axial fan and a second axial fan according to an example embodiment of the present invention arranged in the axial direction.
Figure 7B:
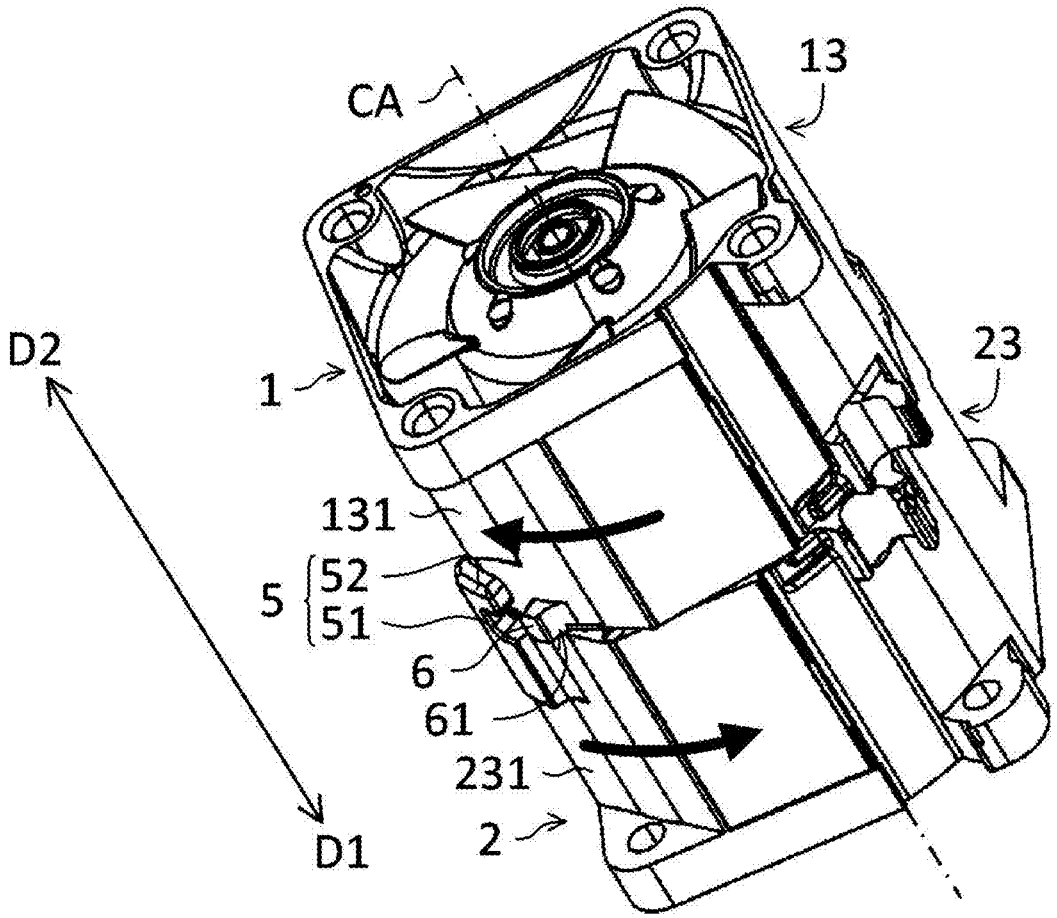
FIG. 7B is an external view illustrating a hooking example of a hook portion and a hooked portion according to an example embodiment of the present invention.
Figure 7C:
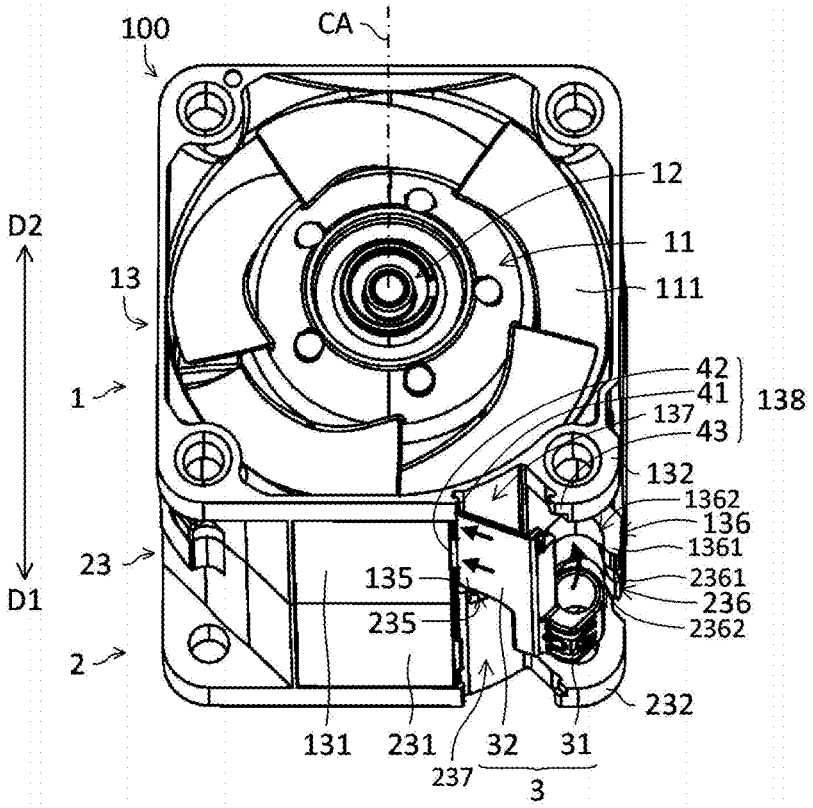
FIG. 7C is an external view illustrating examples of fitting of an extension portion to a claw portion and fitting of a third connecting portion to a first connecting portion and a second connecting portion according to an example embodiment of the present invention.
Figure 7D:
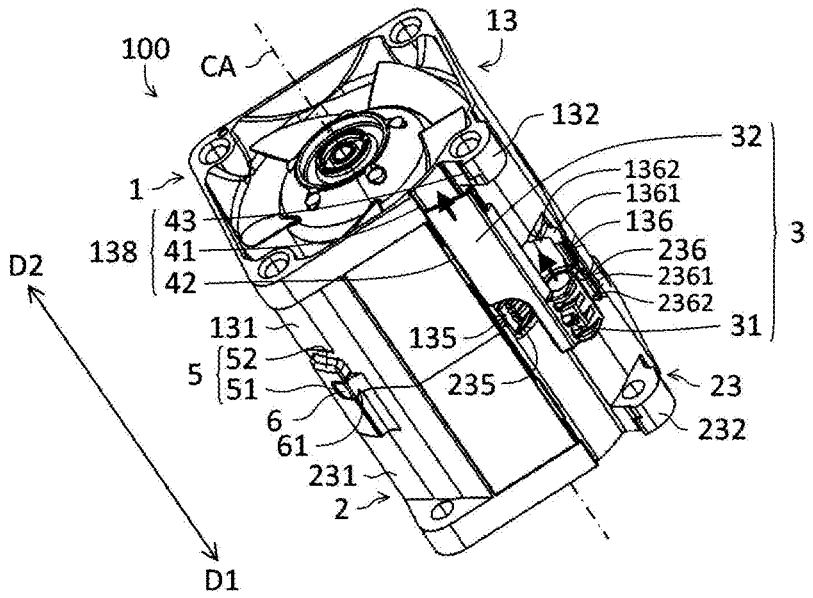
FIG. 7D is an external view showing a slide example of an attachment portion according to an example embodiment of the present invention.

Next, a method of manufacturing the blower 100 will be described with reference to FIGS. 6 to 7D. FIG. 6 is a flowchart for explaining an example of a method of manufacturing the blower 100. FIG. 7A is a perspective view of the first axial fan 1 and the second axial fan 2 arranged in the axial direction. FIG. 7B is an external view illustrating a hooking example of the hook portion 5 and the hooked portion 6. FIG. 7C is an external view illustrating an example of fitting of the extension portion 32 to the claw portions 41 and 42 and fitting of the third connecting portion 31 to the first connecting portion 136 and the second connecting portion 236. FIG. 7D is an external view showing a sliding example of the attachment portion 3. Note that FIGS. 6 to 7D illustrate a method of manufacturing the blower 100 in FIG. 1.

First, as shown in FIG. 7A, the first axial fan 1 and the second axial fan 2 are arranged in the axial direction (step S1). At this time, the hook portion 5 is shifted to one side in the circumferential direction with respect to the hooked portion 6. Further, the first bracket 133 faces the second bracket 233 in the axial direction.

Next, as illustrated in FIG. 7B, the second axial fan 2 is rotated in the other circumferential direction around the central axis CA with respect to the first axial fan 1 in a state where one axial end of the first tubular portion 131 is in contact with the other axial end of the second tubular portion 231 (step S2). As a result, the hook portion 5 is hooked to the hooked portion 6. Therefore, the first axial fan 1 and the second axial fan 2 are connected in series in the axial direction.

Next, as illustrated in FIG. 7C, after the first lead wire 122 and the second lead wire 222 are accommodated in the first passage 137, the attachment portion 3 is attached to the first axial fan 1 and the second axial fan 2 (step S3). Specifically, the method of manufacturing the blower 100 includes the following steps in step S3.

First, one end in the circumferential direction of the extension portion 32 of the attachment portion 3 is hooked by the first claw portion 41 and the second claw portion 42 disposed on one side in the circumferential direction of the radially outer end of at least one of the first passage 137 and the second passage 237 (step S31). For example, as illustrated in FIG. 7C, one circumferential end of the extension portion 32 is inserted between the first claw portion 41 and the second claw portion 42 and one circumferential side of the radially outer end of the first passage 137. At this time, the other circumferential end of the extension portion 32 is disposed on one side in the axial direction with respect to the third claw portion 43. Preferably, the other circumferential end of the extension portion 32 is brought into contact with one axial end of the third claw portion 43.

Then, the columnar third connecting portion 31 is fitted into the recesses 1362 and 2362 of the first connecting portion 136 and the second connecting portion 236 (step S32). For example, as illustrated in FIG. 7C, the attachment portion 3 is rotated about a hooking portion between the first claw portion 41 and the second claw portion 42 and one circumferential end of the extension portion 32. As a result, the third connecting portion 31 rotates toward the first connecting portion 136 and the second connecting portion 236, and is pushed and fitted into the first recess 1362 and the second recess 2362. That is, the third connecting portion 31 is connected to the first connecting portion 136 and the second connecting portion 236.

Further, by sliding the attachment portion 3 in the axial direction, the other circumferential end of the extension portion 32 is hooked by the third claw portion 43 disposed on the other side in the circumferential direction at the end on the opposite side to the first opening 135 and the second opening 235 in the axial direction of the radial outer end of at least one of the first passage 137 and the second passage 237 (step S33). For example, as shown in FIG. 7D, by moving the attachment portion 3 to the other axial side, the other end in the circumferential direction of the extension portion 32 is inserted into the gap between the third claw portion 43 and the radially outer end of the first passage 137. As a result, the other circumferential end of the extension portion 32 is hooked by the third claw portion 43.

Then, the assembly of the blower 100 of FIG. 1 is completed.

According to the above-described manufacturing method, when the attachment portion 3 is attached, the distance for sliding the attachment portion 3 in the axial direction can be significantly shortened. Therefore, it is easy to attach the attachment portion 3 that protects the lead wires 122 and 222. Therefore, the productivity of the blower 100 can be improved.

The example embodiments of the present disclosure have been described above. It is to be noted that the scope of the present disclosure is not limited to the above-described example embodiments. The present disclosure can be implemented by adding various modifications to the above-described example embodiments within a range not departing from the spirit of the disclosure. In addition, the matters described in the above-described example embodiments are arbitrarily combined together as appropriate within a range where no inconsistency occurs.

The example embodiments described so far will be collectively described hereinafter.

For example, a blower disclosed in the present specification is configured to include a first axial fan; a second axial fan connected in series to one axial side of the first axial fan; and an attachment portion attached across radially outer surfaces of the first axial fan and the second axial fan, wherein the first axial fan includes: a first housing having a first tubular portion in a tubular shape extending in an axial direction; a first opening that is disposed at one axial end on a radially outer surface of the first tubular portion and through which a first lead wire is drawn out from an inside of the first tubular portion; and a first connecting portion disposed at one axial end on the radially outer surface of the first tubular portion, the second axial fan includes: a second housing having a second tubular portion in a tubular shape extending in the axial direction; a second opening that is disposed at another axial end on the radially outer surface of the second tubular portion and through which a second lead wire is drawn out from an inside of the second tubular portion; and a second connecting portion disposed at the other axial end on the radially outer surface of the second tubular portion, and the attachment portion includes: a third connecting portion a part of which is connected to the first connecting portion and another part of which is connected to the second connecting portion; and an extension portion that extends in the axial direction from the third connecting portion, is disposed at a radially outer end of at least one of the first tubular portion and the second tubular portion, and surrounds at least one of the first lead wire and the second lead wire together with a radially outer end of at least one of the first tubular portion and the second tubular portion (first configuration).

The blower having the first configuration may be configured such that the extension portion has a plate shape radially opposed to a radially outer end of at least one of the first tubular portion and the second tubular portion (second configuration).

The blower having the first or second configuration may be configured such that the first axial fan further includes: a first impeller rotatable about a central axis extending in the axial direction; and a first motor assembly that is disposed at one side in the axial direction with respect to the first impeller and drives the first impeller, the first tubular portion accommodates the first impeller and the first motor assembly, the second axial fan further includes: a second impeller rotatable about the central axis; and a second motor assembly that is disposed on the other side in the axial direction with respect to the second impeller and drives the second impeller, and the second tubular portion accommodates the second impeller and the second motor (third configuration).

The blower having any of the first to third configurations may be configured to further include: a hook portion that protrudes in the axial direction from one of the first tubular portion and the second tubular portion toward the other of the first tubular portion and the second tubular portion; and a hooked portion that is disposed on the other of the first tubular portion and the second tubular portion and on which the hook portion is hooked in the axial direction (fourth configuration).

The blower having the fourth configuration may be configured such that the hook portion includes: a column portion extending in the axial direction from one of the first tubular portion and the second tubular portion; and a hooking portion extending in at least one of a circumferential direction and a radial direction from a part of the column portion on the other side of the first tubular portion and the second tubular portion in the axial direction, and the hooked portion includes either one of: a protrusion that protrudes radially outward from a radially outer end surface of the other of the first tubular portion and the second tubular portion, and is disposed on one side of the first tubular portion and the second tubular portion in the axial direction with respect to the hooking portion; and a recess that is disposed on the radially outer end surface of the other of the first tubular portion and the second tubular portion, and is recessed in at least one of the circumferential direction and the radial direction and is hooked by the hooking portion (fifth configuration).

The blower having the fourth or fifth configuration may be configured such that the hook portion is in contact with the hooked portion in the circumferential direction (sixth configuration).

The blower having any of the fourth to sixth configurations may be configured such that the outer shapes of the first tubular portion and the second tubular portion as viewed in the axial direction are polygonal shapes having n pieces (n is a natural number of 4 or more) of corner portions, and at least either the first connecting portion and the second connecting portion or the hook portion and the hooked portion are disposed at the corner portions (seventh configuration).

The blower having any of the first to seventh configurations may be configured to further include at least one of: a first flange that extends radially outward from the other axial end of the first tubular portion; and a second flange that extends radially outward from one axial end of the second tubular portion, wherein at least one of the first flange and the second flange has a first through hole extending in the axial direction, the third connecting portion has a second through hole extending in the axial direction, and the second through hole overlaps the first through hole when viewed from the axial direction (eighth configuration).

The blower having any of the first to eighth configurations may be configured such that the attachment portion has a notch that exposes at least one of the first opening and the second opening to the outside when viewed from the radial direction (ninth configuration).

The blower having an of the first to ninth configurations may be configured such that the third connecting portion has a columnar shape extending in the axial direction, the first connecting portion includes a first peripheral wall portion protruding radially outward from the first tubular portion and extending in the axial direction, the first peripheral wall portion constitutes a first recess that is open in the radial direction and the axial direction and into which the third connecting portion is allowed to be fitted in the axial direction, the second connecting portion includes a second peripheral wall portion protruding radially outward from the second tubular portion and extending in the axial direction, and the second peripheral wall portion constitutes a second recess that is open in the radial direction and the axial direction and into which the third connecting portion is allowed to be fitted in the axial direction (tenth configuration).

The blower having any of the first to tenth configurations may be configured to further include at least one of: a first passage disposed in the first tubular portion and extending at least in the other axial direction from the first opening; and a second passage disposed in the second tubular portion and extending at least in one axial direction from the second opening; wherein the extension portion surrounds at least one of the first lead wire and the second lead wire together with at least one of the first passage and the second passage (eleventh configuration).

The blower having the eleventh configuration may be configured such that a circumferential position range in which at least one of the first passage and the second passage is disposed overlaps a circumferential position range in which at least one of the first opening and the second opening is disposed (twelfth configuration).

The blower having the eleventh or twelfth configuration may be configured such that a radially outer end of at least one of the first passage and the second passage has a claw portion for hooking a circumferential end of the extension portion (thirteenth configuration).

The blower having the thirteenth configuration may be configured such that the claw portion includes: a first claw portion disposed at an end of a radially outer end of at least one of the first passage and the second passage on a side opposite to the first opening and the second opening in the axial direction; and a second claw portion disposed away from the first claw portion of the radially outer end of at least one of the first passage and the second passage toward the first opening and the second opening in the axial direction (fourteenth configuration).

A method of manufacturing a blower disclosed in the present specification is a method of manufacturing the blower having the fourteenth configuration, the method including the steps of: hooking one end in the circumferential direction of the extension portion of the attachment portion with the first claw portion and the second claw portion disposed on one side in the circumferential direction of a radially outer end of at least one of the first passage and the second passage; fitting the third connecting portion having a columnar shape into a recess of each of the first connecting portion and the second connecting portion; and by sliding the attachment portion in the axial direction, hooking the other end in the circumferential direction of the extension portion with a third claw portion disposed on the other circumferential side at an end on a side opposite to the first opening and the second opening in the axial direction, of the radially outer end of at least one of the first passage and the second passage (fifteenth configuration).

The present disclosure is useful in a device in which axial fans are connected in series.

Features of the above-described example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A blower comprising:

a first axial fan;

a second axial fan connected in series to one axial side of the first axial fan; and an attachment portion attached across radially outer surfaces of the first axial fan and the second axial fan; wherein the first axial fan includes:

a first housing including a first tubular portion extending in an axial direction extending from a first axial end;

a first opening that is located at the first axial end on a radially outer surface of the first tubular portion and through which a first lead wire is drawn out from an inside of the first tubular portion; and a first connecting portion located at the first axial end on the radially outer surface of the first tubular portion;

the second axial fan includes:

a second housing including a second tubular portion extending in the axial direction;

a second opening that is located at a second axial end on the radially outer surface of the second tubular portion and through which a second lead wire is drawn out from an inside of the second tubular portion, the second axial end opposing the first axial end; and a second connecting portion located at the second axial end on the radially outer surface of the second tubular portion; and the attachment portion includes:

a third connecting portion, a portion of which is connected to the first connecting portion and another portion of which is connected to the second connecting portion; and an extension portion that extends in the axial direction from the third connecting portion to a position farther in the axial direction than all other portions of the third connecting portion, is located at a radially outer end of at least one of the first tubular portion and the second tubular portion, and, together with a radially outer end of at least one of the first tubular portion and the second tubular portion, surrounds at least one of the first lead wire and the second lead wire.

2. The blower according to claim 1, wherein the extension portion has a plate shape radially opposed to a radially outer end of at least one of the first tubular portion and the second tubular portion.

3. The blower according to claim 1, wherein the first axial fan further includes:

a first impeller rotatable about a central axis extending in the axial direction; and a first motor assembly that is located at a first side in the axial direction with respect to the first impeller to drive the first impeller;

the first tubular portion accommodates the first impeller and the first motor assembly;

the second axial fan further includes:

a second impeller rotatable about the central axis; and a second motor assembly that is located on a second side in the axial direction with respect to the second impeller to drive the second impeller, the first side being opposite from the second side; and the second tubular portion accommodates the second impeller and the second motor.

4. The blower according to claim 1, further comprising at least one of:

a first flange that extends radially outward from an additional axial end of the first tubular portion opposed to the first axial end of the first tubular portion; and a second flange that extends radially outward from an additional axial end of the second tubular portion opposite to the second axial end of the second tubular portion; wherein at least one of the first flange and the second flange includes a first through hole extending in the axial direction;

the third connecting portion includes a second through hole extending in the axial direction; and the second through hole overlaps the first through hole when viewed from the axial direction.

5. The blower according to claim 1, wherein the attachment portion includes a notch that exposes at least one of the first opening and the second opening to outside when viewed from the radial direction.

6. The blower according to claim 1, wherein the third connecting portion has a columnar shape extending in the axial direction;

the first connecting portion includes a first peripheral wall portion protruding radially outward from the first tubular portion and extending in the axial direction;

the first peripheral wall portion defines a first recess that is open in the radial direction and the axial direction and into which the third connecting portion is allowed to be fitted in the axial direction;

the second connecting portion includes a second peripheral wall portion protruding radially outward from the second tubular portion and extending in the axial direction; and the second peripheral wall portion defines a second recess that is open in the radial direction and the axial direction and into which the third connecting portion is allowed to be fitted in the axial direction.

7. The blower according to claim 1, further comprising at least one of:

a first passage located in the first tubular portion and extending at least in the other axial direction from the first opening; and a second passage located in the second tubular portion and extending at least in one axial direction from the second opening; wherein the extension portion, together with at least one of the first passage and the second passage, surrounds at least one of the first lead wire and the second lead wire.

8. The blower according to claim 7, wherein a circumferential position range in which at least one of the first passage and the second passage is located overlaps a circumferential position range in which at least one of the first opening and the second opening is located.

9. The blower according to claim 7, wherein a radially outer end of at least one of the first passage and the second passage includes a claw portion to hook a circumferential end of the extension portion.

10. The blower according to claim 9, wherein the claw portion includes:

a first claw portion located at an end of a radially outer end of at least one of the first passage and the second passage on a side opposite to the first opening and the second opening in the axial direction; and a second claw portion located away from the first claw portion of the radially outer end of at least one of the first passage and the second passage toward the first opening and the second opening in the axial direction.

11. A method of manufacturing the blower according to claim 10, the method comprising:

hooking one end in the circumferential direction of the extension portion of the attachment portion with the first claw portion and the second claw portion located on one side in the circumferential direction of a radially outer end of at least one of the first passage and the second passage;

fitting the third connecting portion having a columnar shape into a recess of each of the first connecting portion and the second connecting portion; and by sliding the attachment portion in the axial direction, hooking another end in the circumferential direction of the extension portion with a third claw portion located on the other circumferential side at an end on a side opposite to the first opening and the second opening in the axial direction, of the radially outer end of at least one of the first passage and the second passage.

12. A blower, comprising:

a first axial fan;

a second axial fan connected in series to one axial side of the first axial fan; and an attachment portion attached across radially outer surfaces of the first axial fan and the second axial fan; wherein the first axial fan includes:

a first housing including a first tubular portion extending in an axial direction extending from a first axial end;

a first opening that is located at a first axial end on a radially outer surface of the first tubular portion and through which a first lead wire is drawn out from an inside of the first tubular portion; and a first connecting portion located at the first axial end on the radially outer surface of the first tubular portion;

the second axial fan includes:

a second housing including a second tubular portion extending in the axial direction;

a second opening that is located at a second axial end on the radially outer surface of the second tubular portion and through which a second lead wire is drawn out from an inside of the second tubular portion, the second axial end opposing the first axial end; and a second connecting portion located at the second axial end on the radially outer surface of the second tubular portion;

the attachment portion includes:

a third connecting portion, a portion of which is connected to the first connecting portion and another portion of which is connected to the second connecting portion; and an extension portion that extends in the axial direction from the third connecting portion, is located at a radially outer end of at least one of the first tubular portion and the second tubular portion, and, together with a radially outer end of at least one of the first tubular portion and the second tubular portion, surrounds at least one of the first lead wire and the second lead wire;

the blower further includes a hook portion that protrudes in the axial direction from one of the first tubular portion and the second tubular portion toward another of the first tubular portion and the second tubular portion; and the blower further includes a hooked portion that is located on the other of the first tubular portion and the second tubular portion and on which the hook portion is hooked in the axial direction.

13. The blower according to claim 12, wherein the hook portion includes:

a column portion extending in the axial direction from one of the first tubular portion and the second tubular portion; and a hooking portion extending in at least one of a circumferential direction and a radial direction from a portion of the column portion on one of the first side in the axial direction and the second side in the axial direction of the first tubular portion and the second tubular portion in the axial direction; and the hooked portion includes either one of:

a protrusion that protrudes radially outward from a radially outer end surface of the other of the first tubular portion and the second tubular portion, and is located on another of the first side in the axial direction and the second side in the axial direction of the first tubular portion and the second tubular portion with respect to the hooking portion; and a recess that is located on the radially outer end surface of the other of the first tubular portion and the second tubular portion, and is recessed in at least one of the circumferential direction and the radial direction and is hooked by the hooking portion.

14. The blower according to claim 12, wherein the hook portion is in contact with the hooked portion in the circumferential direction.

15. The blower according to claim 12, wherein outer shapes of the first tubular portion and the second tubular portion as viewed in the axial direction are polygonal shapes having n pieces of corner portions, where n is a natural number of 4 or more; and at least either the first connecting portion and the second connecting portion or the hook portion and the hooked portion are located at the corner portions.

* * * * *